US005938576A

United States Patent [19]

Minor

[11] Patent Number: 5,938,576

[45] Date of Patent: Aug. 17, 1999

[54] SCIATIC EXERCISE BENCH

[76] Inventor: Patsy A. Minor, 617 Evergreen St., Okawville, Ill. 62271

[21] Appl. No.: 09/130,611

[22] Filed: Aug. 6, 1998

[51] Int. Cl.[6] ..... A63B 26/00

[52] U.S. Cl. ..... 482/142; 482/140; 482/145

[58] Field of Search ..... 482/96, 130, 140–148; 297/19, 29, 316, 320, 324, 284.1, 284.4, 284.7, 284.8

[56] References Cited

U.S. PATENT DOCUMENTS

| | | | |
|---|---|---|---|
| 5,403,258 | 4/1995 | Hill | 482/140 |
| 5,551,937 | 9/1996 | Kwo | 482/144 |
| 5,577,987 | 11/1996 | Brown | 482/140 |

*Primary Examiner*—Glenn Richman

*Attorney, Agent, or Firm*—Joseph N. Breaux

[57] ABSTRACT

A exercise bench particularly suitable for persons with lower back pain wherein the bench comprises a hard foam ridged mat hinged to an upper body support and head rest at one end thereof and having an adjustable angular support for supporting the upper body and head rest at a desired angle by the user. A pair of arched padded knee rails extends outwardly from the far side ends of the hard foam mat providing locations for depressing one's knees while performing legs raising exercises. A pair of padded hand rails extends up and over the padded knee rails and provides the locations for supporting oneself while performing exercises and exiting or entering the exercise bench. An adjustable height foot rest support extends between the pair of hand rails and at opposite ends of the hard foam mat from the upper body support and head rest. The height of the foot rest support is adjustable by the user to a desired height.

4 Claims, 1 Drawing Sheet

SCIATIC EXERCISE BENCH

TECHNICAL FIELD

The present invention relates to devices and methods for exercising and more particularly to devices and methods for a sciatic exercise bench which is for use by people with lower back pain comprising a hard foam center hinged to an upper body support and head rest at one end thereof having an adjustable angular support for supporting the upper body and head rest at a desired angle, a pair of padded knee rails extending outward from the far side ends of the hard foam mat, a pair of padded hand rails extending up and over the padded knee rail and an adjustable height foot rest pad support extending between the pair of hand rails at the opposite end of the hard foam mat. The height of the foot rest support is adjustable by the user to a desired height.

BACKGROUND ART

Persons who suffer from lower back pain, sciatica, sometime find relief from performing several exercises that relieve the pain, however most of these exercises require the use of a table and chair in combination. The present invention provides a useful exercise bench which takes the place of the table and chair method and provides a better way to exercise a persons lower body. Prior to the present invention there has never been an exercise bench which is specifically directed toward persons with lower back pain and which comprises the elements described herein.

Prior art patents which are relevant are as follows:

Rifas, U.S. Pat. No. 5,647,829 which discloses an abdominal exercise apparatus and methods.

Chen, U.S. Pat. No. 5,643,163 discloses a gymnastic apparatus.

Anderson, U.S. Pat. No. 5,496,247 discloses a back builder.

Rouillard, et al, U.S. Pat. No. 5,472,402 which discloses a ramp, horizontal, on bench adjustable stretch bench for relieving a user's back pain.

Sanfani, et al, U.S. Pat. No. 5,441,473 which discloses a compact back exerciser.

Hill, U.S. Pat. No. 5,403,258 which discloses an abdominal and lumbar therapy and exercise apparatus.

As can be seen from the prior inventions there has never been an invention as the present which includes all the elements necessary for effectively exercising a persons lower back to relieve lower back pain such as sciatica. The present invention overcomes the deficiencies of the prior art in providing an effective exercise bench which comprises a base frame work with several attachment components including a ridged foam mat, an adjustable padded upper body and head rest support, an adjustable padded foot rest, two padded half round knee rails, and two sturdy metal hand rails.

GENERAL SUMMARY DISCUSSION OF INVENTION

It is thus an object of the invention to provide a Sciatic Exercise Bench that is an exercise device specifically designed to aid those who need to strengthen lower back and leg muscles and help relieve lower back pain such as sciatica.

It is a further object of the invention to provide a Sciatic Exercise Bench that consists of a base frame work with several attachment components including a ridged foam mat and adjustable padded upper body and head rest support, an adjustable padded foot rest, two padded half round knee rails and sturdy metal hand rails. Furthermore wherein the base frame work is tapered measuring approximately 14 inches wide at the head rest and upper body support hinged area and approximately 18 inches wide at the foot rest end while the hand rails, knee rails, and foot rest components are detachable for easy storage and transport.

Accordingly, a sciatic exercise bench is provided for use by people with lower back pain and for use to strengthen a user's lower back and legs muscles in order to help relieve lower back pain which device comprises a hard foam center mat hinged to an upper body support and head rest at one end thereof having an adjustable angular support for supporting the upper body and head rest at a desired angle; a pair of padded knee rails extending outward from the far side ends of the hard foam mat; a pair of padded hand rails extending up and over the padded knee rail and an adjustable height foot rest pad support extending between the pair of hand rail at the opposite end of the hard foam mat, the head of the foot rest support is further adjustable by the user to a desired height, additionally, hand rails, knee rails, and foot rest components are detachable for easy storage and transport.

BRIEF DESCRIPTION OF DRAWINGS

For a further understanding of the nature and objects of the present invention, reference should be had to the following detailed description, taken in conjunction with the accompanying drawings, in which like elements are given the same or analogous reference numbers and wherein.

EXEMPLARY MODE FOR CARRYING OUT THE INVENTION

It can be seen from the following description that in use one who suffers from sciatica (or anyone who simply desires to exercise and strengthen one's lower back and upper leg muscles) could simply lay on their back on the sciatic exercise bench padded foam mat with their head or upper body on the elevated and adjustable head and upper body rest. The user would then perform a variety of muscle conditioning exercises including leg lifts, pressing their raised knees against the padded knee rails, wrapping legs around the padded rails and squeezing inwardly, standing, extending one's leg, placing one's heels against the foot rest while holding on to the hand rails, etc. As the user becomes stronger through repetitions of the leg lifts a user would have the option to gradually lower the head and upper body rest downward utilizing the adjustable support causing the leg lifts to become more difficult. This will enable the user to tailor the exercises to their present body strength while not further injuring one's back. Use of the sciatic exercise bench would allow one who suffers from sciatica to condition their back easily and conveniently while relieving pain and strengthen the muscles related thereto.

Figure 1:
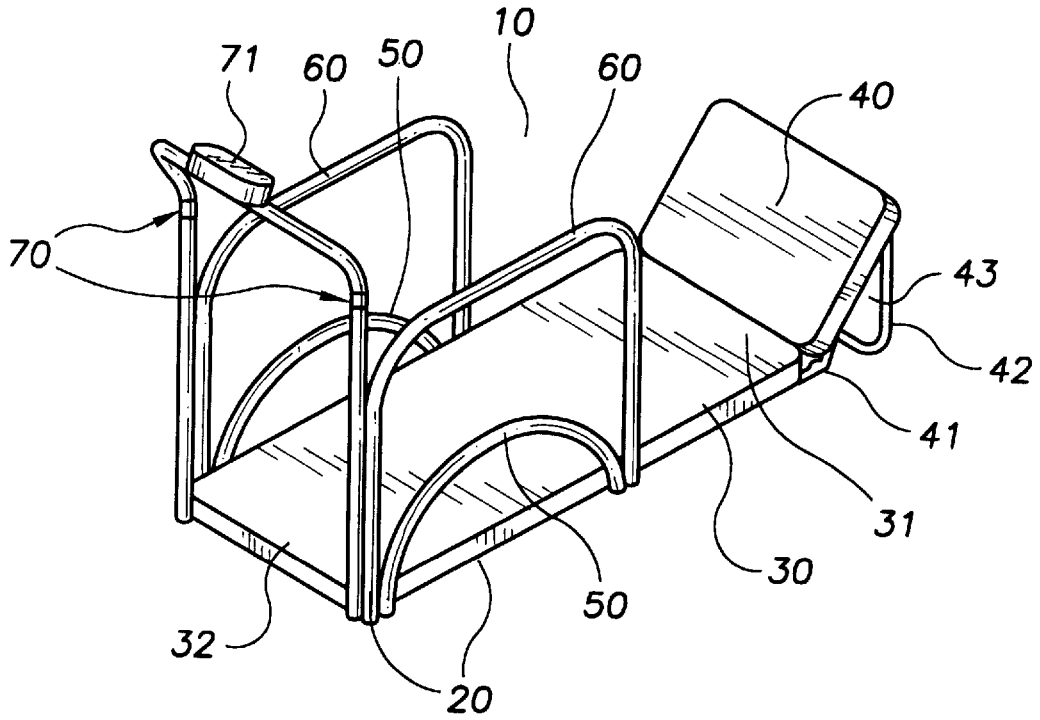
FIG. 1 is an isometric view of the sciatic exercise bench illustrating an adjustable foot rest, positioning of the hand rails, hinged and adjustable upper body and head rest support, base hard foam mat, and base frame work.
Figure 2:
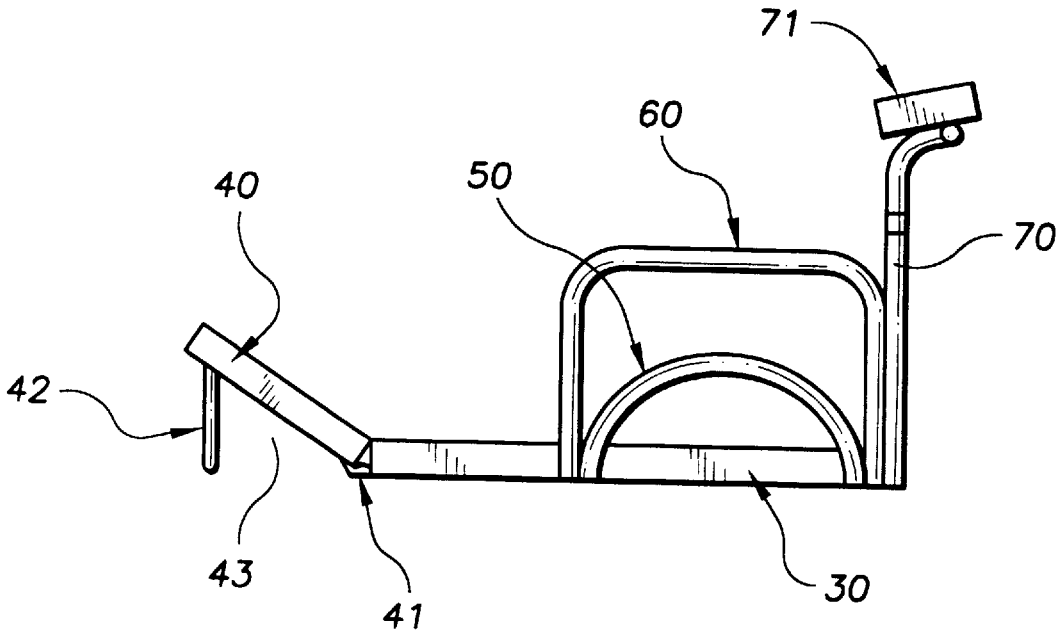
FIG. 2 is a side view illustrating the features of the sciatic exercise bench.

Referring to the figures in detail FIG. 1 is an isometric view of the sciatic exercise bench 10 which consist of a base frame work 20. The base frame work 20 is preferably tubular member which are arranged to support the various pads and supports described herein the tubular members are preferably joined by welding, bolts, or any other suitable and known method. Furthermore the tubular members are coated with anti-corrosive coating to prevent the sweat from the user from corroding the work out bench prematurely.

A ridged foam mat 30 forms a base of the sciatica work out bench and is preferably constructed of a foam material covered with watering impermeable material which prevents sweat form permeating the coating and saturating the foam. The foam material is preferably about 2 inches thick and while the ridged foam mat is about 18 inches to about 2 feet wide and about 3 feet in length. The ridged foam mat has a head end 31 and a foot end 32. The head end of the ridged foam mat has a hinged upper body and head support mat 40. The upper body and head rest support 40 is constructed similarly to the ridged foam mat and includes hinged connection 41 which connects to the head portion of the ridged foam mat and a height adjustable rod 42 extending from a bottom surface 43. The height adjustment rod 42 provides for angular and height adjustment of the upper body and head support to a desired height for a user's needs. Normally a person with sever lower back pain would adjust the head and upper body support to a higher position when beginning exercising on the sciatic exercise bench. A pair of padded knee rails 50 extends outwardly from the side ends of the ridged foam mat 30. The padded knee rails are constructed as half round knee rails or shaped as half a circle. The padded knee rails provide a location for the user to depress his/her knee's against the knee rails while performing leg lifts. The highest portion of the padded knee rail is approximately 12 to about 20 inches high. This height provides sufficient height for leg raises. The arch shape of the padded knee rails provides numerous locations in heights for persons varying dimensions.

A pair of padded hand rails 60 extend up and over the padded knee rail and provide locations for grasping while performing exercises. The padded hand rail may also be used to support oneself while lowering into the exercise bench or exercising on the exercise bench.

At the foot end 32 of the ridged foam mat is a pair extensions 70 providing supports for an adjustable height foot rest pad 71 which is centrally located between the two supports. The support members 70 are supported by a pair of hand rails at opposite ends of the hard foam mat. The height of the foot rest support is adjusted by the user to a desired height by use of a bias retaining button located in each adjustable support member 70.

It is noted that the embodiment of the Sciatic Exercise Bench described herein in detail for exemplary purposes is of course subject to many different variations in structure, design, application and methodology. Because many varying and different embodiments may be made within the scope of the inventive concept(s) herein taught, and because many modifications may be made in the embodiment herein detailed in accordance with the descriptive requirements of the law, it is to be understood that the details herein are to be interpreted as illustrative and not in a limiting sense.

What is claimed is:

1. A Exercise Bench comprising:

a) a tubular base framework forming a rectangular framework with interconnecting support members wherein the tubular members are fixedly secured forming a stable rigid frame, b) a rigid foam center mat attached to the tubular base framework with a head end, a foot end, and sides, and wherein the foam is high density foam with a water impermeable cover, c) an upper body support pad hingedly secured to the head end of the rigid foam center mat, with a upper body support pad height adjustment rod attached to a bottom surface of the upper body support pad and which adjustment rod is utilized to adjust the height of the upper body support pad by changing the angle of the adjustment rod, d) a pair of half round padded knee rails extending upwardly from each side of the rigid foam mat and with one end of the half round padded knee rails attached near the foot end of the center mat and the other end of the half round padded knee rail attached near the head end of the center mat and further wherein the half round knee rail is a tubular member covered with foam padding material, e) a pair of padded hand rails extending up and over the padded knee rails, wherein the hand rails have one end connected to the base framework near the foot end of the frame work and another end attached to the base framework near the head end of the base framework, the hand rails are constructed of tubular members and are covered with padding material, and f) a height adjustable foot rest pad centrally located between the pair of hand rails at the foot end of the rigid foam mat and supported by a pair of extendable supports attached to the foot end of the base framework and additionally supported by the hand rail ends which attach to the foot end of the base framework.

2. The Sciatic Exercise Bench of claim 1, wherein the rigid foam center mat further comprises a tapered foam mat that is thicker near the head end of the foam mat and thinner near the foot end of the foam mat.

3. The Sciatic Exercise Bench of claim 1, wherein the upper body support pad further comprises a upper body support pad with an centrally located indented area for conforming the pad to the shape of a user's head thereby providing comfort to a user.

4. The Sciatic Exercise Bench of claim 1 wherein the foot pad further comprises a foot pad with a means for height adjusting the foot rest pad, wherein the height adjustment means comprises two fixedly secured tubular members attached to each side near the foot end of the base frame and each separately supported by the hand rail ends attached to the foot end of the base frame, while an extending member is slidably received by each secured tubular member and centrally connected to form a mounting means for the foot rest pad.

* * * * *